United States Patent [19]

Penning

[11] Patent Number: 4,948,376

[45] Date of Patent: Aug. 14, 1990

[54] CONNECTOR

[75] Inventor: Cornelis Penning, Eindhoven, Netherlands

[73] Assignee: U.S. Philips Corporation, New York, N.Y.

[21] Appl. No.: 413,353

[22] Filed: Sep. 27, 1989

[30] Foreign Application Priority Data

Oct. 5, 1988 [NL] Netherlands ..... 8802434

[51] Int. Cl.[5] ..... H01R 13/70

[52] U.S. Cl. ..... 439/188; 200/51.1; 439/650

[58] Field of Search ..... 439/188, 620, 107, 650, 439/653, 651, 652; 200/51.1, 51.09; 333/22 R, 260

[56] References Cited

U.S. PATENT DOCUMENTS

| | | | |
|---|---|---|---|
| 3,525,056 | 8/1970 | Qurashi | 200/51.1 |
| 3,983,338 | 9/1976 | Mathauser | 379/30 |
| 4,034,172 | 7/1977 | Glover et al. | 439/188 |
| 4,804,339 | 2/1989 | Cohen | 439/588 |

FOREIGN PATENT DOCUMENTS 8400115 1/1985 Netherlands .

*Primary Examiner*—Neil Abrams
*Attorney, Agent, or Firm*—William Squire

[57] ABSTRACT

A connector having an electrically insulating housing (43) comprising electrically conductive connection elements (13, 15, 17) each having two first contact members (1, 3, 5) and a connection member (7, 9, 11) as well as two electrically parallel arranged, normally closed switches each of which in the closed condition forms an electric connection between one of the connection elements (15) and a first terminal (23) of a resistance element (25), the second terminal of which (27) is electrically conductively connected to another connection element (13). Each switch comprises an operating member (39, 41) which is capable of cooperating with a plug to be inserted into the housing (43) so that when the plug is inserted the switch in question is opened. In order to be able to construct the connector in a simple manner from a comparatively small number of components to be manufactured in series production, at least the part of each connection element (13, 15, 17) which comprises the first contact members (1, 3, 5) is formed from one piece of sheet material while an electrically conductive switching plate (29) also formed from one piece of sheet material is connected to a terminal (23) of the resistance element (25). The switching plate (29) comprises a first switching contact (31, 33) of each of the two switches, the second switching contact (35, 37) of which forms one assembly with the said part of one of the operating elements (15).

6 Claims, 4 Drawing Sheets

CONNECTOR

Figure 1:
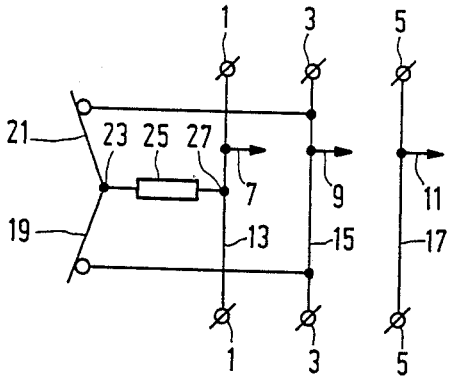

The invention relates to a connector comprising an electrically insulating housing comprising at least two connection elements formed from an electrically conductive material each of which comprises two first contact members and a connection member, as well as two electrically parallel arranged normally closed switches each of which in the closed condition forms an electric connection between on the one hand one of the connection elements and on the other hand a first terminal of a resistance element, the second terminal of which is electrically conductively connected to another connection element, each one of the said switches comprises an operating member which is designed to cooperate with a plug having second contact members which are capable of cooperating with the first contact members, all this in such a member that when a plug is inserted into the housing one of the two switches is opened.

Such a connector can be rigidly connected, via the connection members (for example, soldering lugs) to an apparatus (for example an audio or video apparatus) which may then be through-connected via a cable connected to a plug to another apparatus having the same connector. The cable may form part of a bus system as described, for example in NL-A-84 00 115 (PHN 10,904). Since each connector can cooperate with two plugs a large number of apparatuses can be connected in this manner with the bus system. The resistance element serves as an artificial load when one of the two plugs is not connected to the connector.

It is an object of the invention to provide a connector of the type mentioned in the opening paragraph which can be composed in a simple manner from a comparatively small number of parts, so that it can easily be manufactured in an automated production process.

For that purpose the connector according to the invention is characterized in that at least the part of each connection element which comprises the first contact members is formed from one piece of sheet material, that an electrically conductive switching plate also formed from one piece of sheet material is connected to a terminal of the resistance element and comprises a first switching contact of each of the two stitches, and that the second switching contact of each of the two stitches forms a unitary structure with the said part of one of the connection elements.

So the connector according to the invention comprises a housing which can be manufactured, for example, from a synthetic resin by injection moulding, a number of components formed substantially from sheet material (for example, by punching) and a resistance element. Each of these composing parts can simply be manufactured in a series production and the composition thereof to a connector can also be automated easily.

The connection members can be connected to the said part of the connection means optionally by welding or soldering. A preferred embodiment of the connector according to the invention in which this process is omitted is characterized in that the connection members together with the first contact members and optionally the second switching contacts are formed as a unitary structure from one piece of sheet material.

The housing may be manufactured separately after which the remaining components are combined with the housing to form the complete connector. An embodiment of the connector according to the invention manufactured in this manner is characterized in that the resistance element, the connection elements and the switching plate are placed in apertures recessed in the preformed housing, the switching plate engaging the first terminal of the resistance element and one of the connection elements engaging the second terminal, and that the second switching contacts are movable and comprise the operating members.

Another embodiment in which the formation of a part of the housing is associated with the connection of other components in the said part of the housing is characterized in that the switching plate comprises a first projecting part and, together with a connection plate comprising a second projecting part, is embedded in a synthetic resin envelope which forms a part of the housing, that the first terminal of the resistance element is connected to the first projecting part and the second terminal to the second projecting part, that the first switching contacts are movable and comprise the operating members, and that the connection plate is further connected to one of the connection elements.

Figure 2:
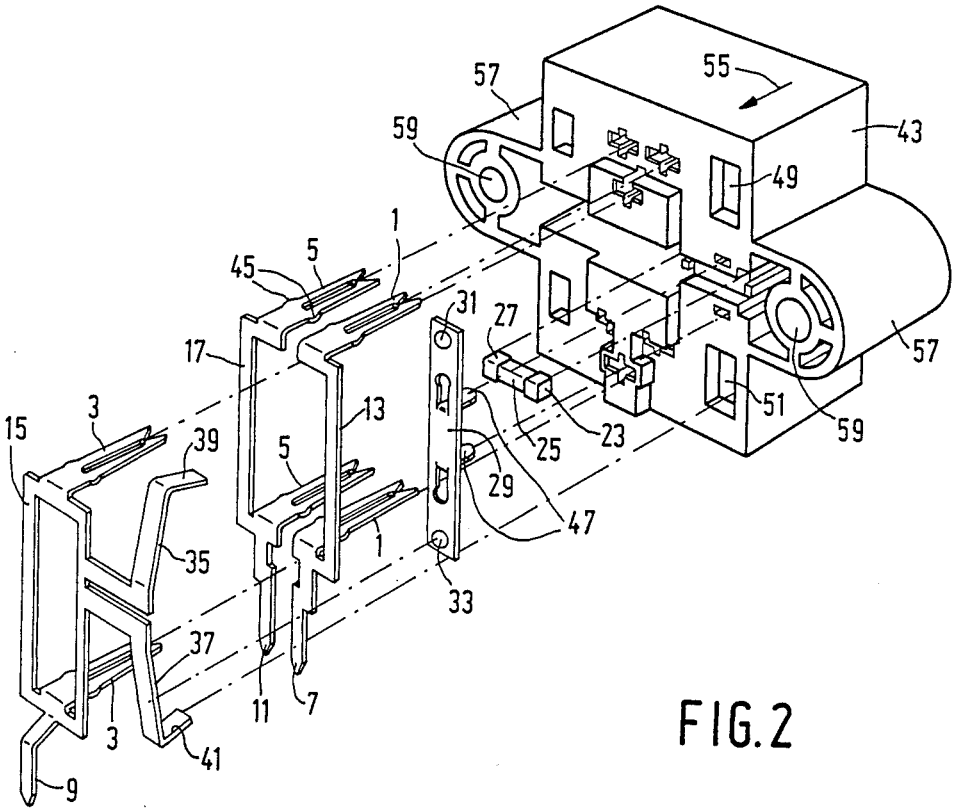
Figure 3:
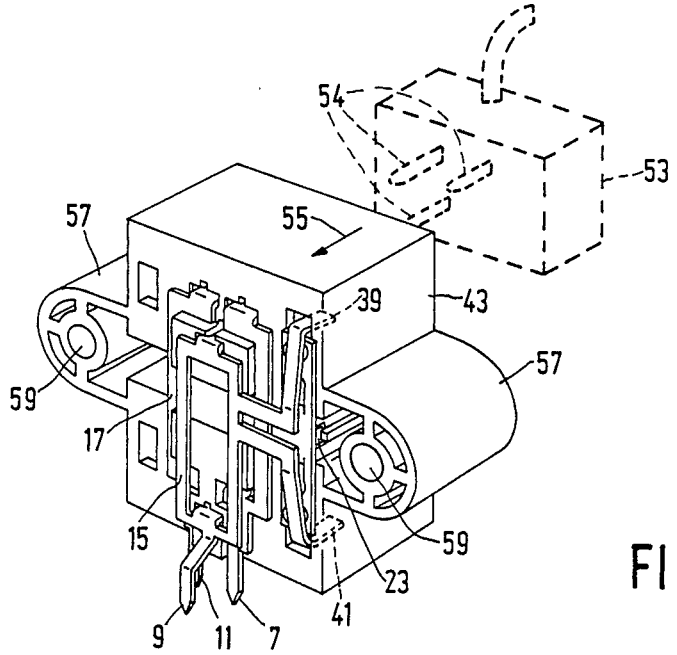
Figure 4A:
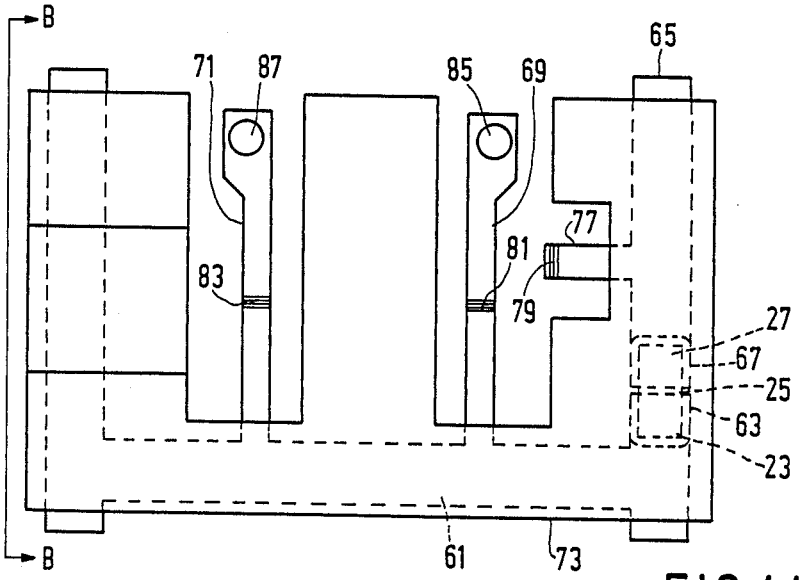
Figure 4B:
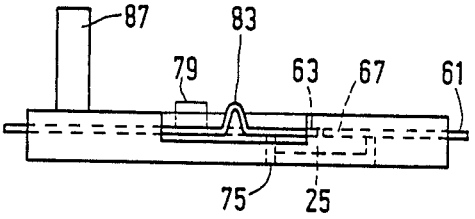
Figure 5A:
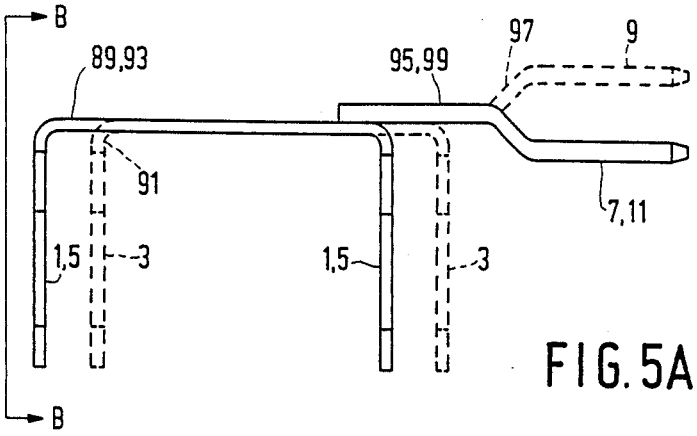
Figure 5B:
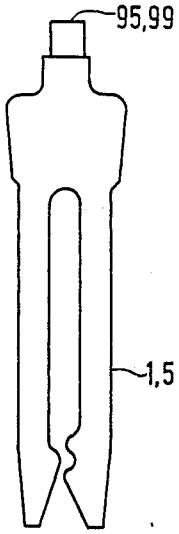
Figure 6A:
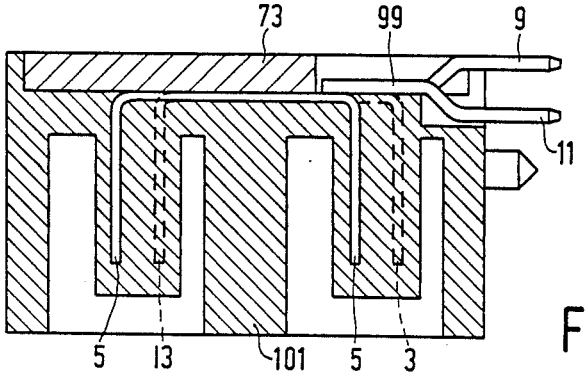
Figure 6B:
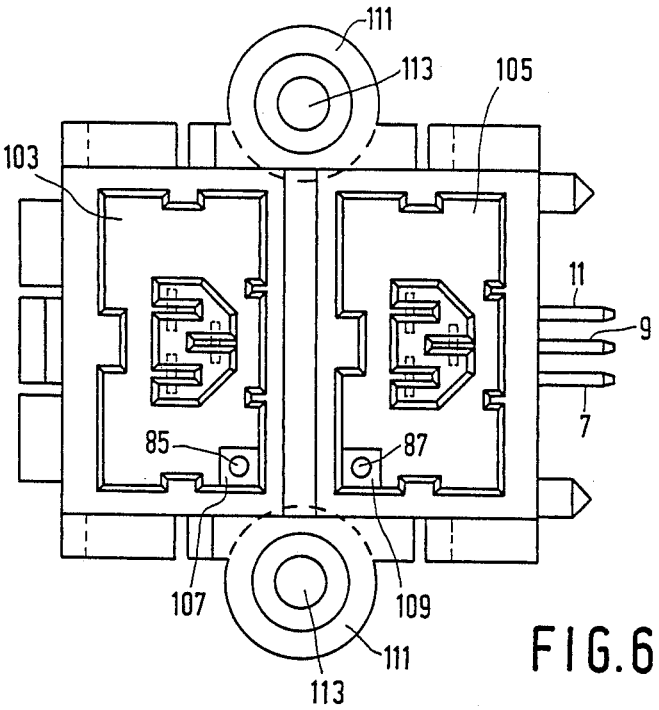
Figure 6C:
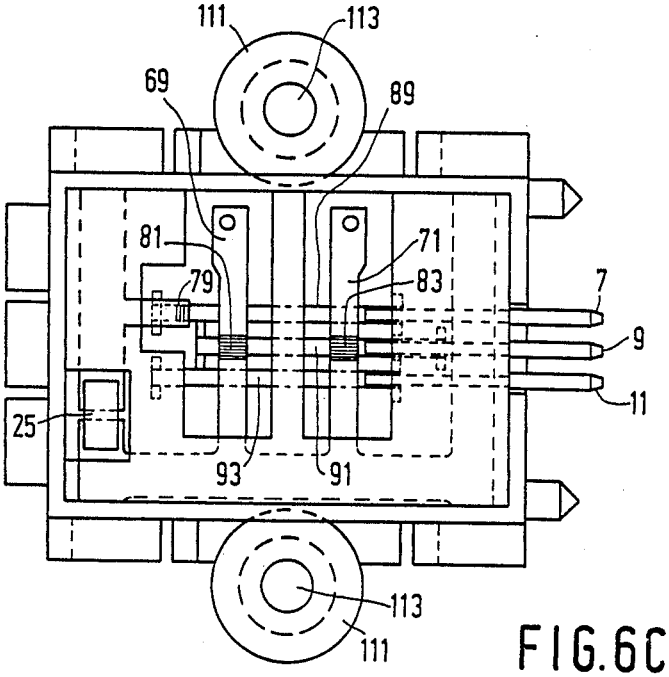

The invention will now be described in greater detail with reference to the drawing, in which FIG. 1 shows an electric circuit diagram of an embodiment of the connector according to the invention, FIG. 2 is an exploded view of a first embodiment of the connector according to the invention, FIG. 3 is a perspective elevation of the connector shown in FIG. 2, FIGS. 4A and 4B are a plan view and a side elevation, respectively, of a part of a second embodiment of the connector according to the invention, FIGS. 5A and 5B are a side elevation and a front elevation, respectively, of a connection element of the second embodiment, and FIGS. 6A, 6B and 6C are a cross-sectional view, a plan view and an underneath view, respectively, of the second embodiment.

FIG. 1 shows an electric circuit diagram of a connector which comprises three pairs of first contact members 1, 3, 5, each pair of first contact members being electrically connected together and to connection members 7, 9, 11, respectively, to form connection elements 13, 15, 17, respectively. The first contact members 1, 3, 5, for example, are socket contact members which can cooperate with second contact members, for example pin contact members of a plug (not shown). The connection members 7, 9, 11 are, for example, soldering lugs or pins which can be rigidly connected to an apparatus. The connector furthermore comprises two electrically parallel arranged normally closed switches 19, 21. In the closed condition which is shown in FIG. 1 each of these switches forms an electric connection between on the one hand the central connection element 15 and on the other hand a first terminal 23 of the resistance element 25, the second terminal 27 of which is electrically conductively connected to the left-hand connection element 13. The switches 19, 21 each comprise an operating member which is not shown in the Figure and which is designed to cooperate with one of the said plugs so that by inserting one of the plugs one of the switches is opened. The result of this is that the resistance element 25 is connected as a terminating resistor between the two connection elements 13, 15 unless both switches are connected to the connector.

FIGS. 2 and 3 show a first embodiment of a connector according to the invention the electric circuit diagram of which corresponds to that of FIG. 1. In this example each of the connection elements 13, 15, 17 together with the first contact members 1, 3, 5 and the connection members 7, 9, 11 are formed one piece of electrically conductive sheet material. The connector further comprises a switching plate 29 which is also formed from one piece of sheet material and which comprises first switching contacts 31, 33 of the switches 19 and 21, respectively. The first switching contacts 31, 33 in this example are the rigid contacts of the switches 19, 21. Two switching contacts 35 and 37, respectively (the movable contacts) are formed as one assembly with the central connection element 15. The free ends are bent through approximately 90° so as to form the operating members 39 and 41, respectively, with which the switches 19 and 21, respectively can be opened. The connection elements 13, 15, 17 and the switching plate 29 may be formed from ribbon-shaped material (for example, phosphorus bronze) by punching and bending in a manner which is conventionally used for series production.

The resistance element 25 preferably is a resistor suitable for surface mounting known per se having metallised ends which constitute the terminals 23, 27. All the said components are placed in a preformed housing 43 which is formed, for example, from an electrically insulating synthetic resin by injection moulding in which apertures are recessed for receiving the said components. The switching plate 29 engages the first terminal 23 of the resistance element 25 and the connection element 13 engages a second terminal 27. The first contact members 1, 3, 5 comprise flukes 45 with which they are locked in the housing 43. The switching plate 29 comprises lugs 47 for the same purpose. The operating members 39, 41 of the switches 19, 21 project through continuous apertures 49, 51 in the housing 43 so that they can cooperate with plugs 53 one of which is shown diagrammatically in FIG. 3 in broken lines. The plugs 53 comprise second contact members 54 which can cooperate with the first contact members 1, 3, 5. They can be inserted on the side of the housing 43 not visible in FIGS. 2 and 3. The front face of the plug then exerts a force on the operating member 39 in the direction of the arrow 55. As a result of this the second switching contact 35 is moved away from the first switching contact 31 so that the switch 19 is opened.

The housing 43 comprises two laterally projecting parts 57 with continuous holes 59 through which bolts can be inserted for connecting the connector to an apparatus (not shown).

FIGS. 4A and 4B are a plan view and a side elevation, respectively, of a part for a second embodiment of a connector with the electric circuit diagram as shown in FIG. 1. This part comprises a switching plate 61 having a first projecting part 63 as well as a connection plate 65 having a second projecting part 67. The first switching contacts 69 and 71 in the form of resilient arms are present on the switching plate 61 and in this example constitute the movable contacts of the switches 19, 21. The switching plate 61 and the connection plate 65 are formed as a unitary structure by punching and bending from sheet material (for example, a ribbon of phosphorus bronze) in such a manner that the projecting parts 63 and 67 are connected together. This assembly has then bend embedded in a first envelope 73 of an electrically insulating synthetic resin, for example, by injection moulding. At the area of the projecting parts 63, 67 in the envelope 73 an aperture 75 is recessed and via the said aperture the said projecting parts are separated from each other by means of a suitable cutting tool. The resistance element 25 which is equal to the resistance element shown in FIG. 2, is then placed in the aperture 75 and the first terminal is soldered to the first projecting part 63 and the second terminal 27 is soldered to the second projecting part 67.

Approximately halfway their length the first switching contacts 69 and 71 are bent so that upwardly directed bulges 81 and 83 are formed which serve as contact places and are capable of cooperating with the second switching contacts to be described hereinafter. Near their free ends, the first switching contacts comprise apertures in which rod-shaped operating members 85 and 87 (for example, a synthetic resin) are provided. The connection plate 65 furthermore comprises a third projecting part 77 the free end portion of which is bent so that an upwardly directed bulge 79 is formed, the function of which will be explained hereinafter.

FIGS. 5A and 5B are a side elevation and a front elevation, respectively, of a connection element which may be used in the second embodiment of the connector according to the invention. FIG. 5A shows two embodiments of the connection element in which the embodiment of the two extreme connection elements (13 and 17 in FIG. 1) is shown in solid lines and that for the central connection element 15 is shown in broken lines. Each connection element 13, 15, 17 in this example comprises a first part 89, 91, 93 formed from electrically conducting sheet material by punching and bending which comprises the two first contact members 1, 3, 5 and a second part 95, 97, 99 connected thereto by soldering or welding in the form of an electrically conductive pin, the free end of which constitutes the connection members 7, 9, 11.

FIG. 6A shows that the connection elements 13, 15, 17 shown in FIGS. 5A and 5B are embedded in an electrically insulating second envelope 101 formed, for example, by injection moulding on the top side of which the first envelope 73, shown in FIGS. 4A and 4B is connected so as to form a housing the appearance of which is substantially equal to the appearance of the housing 43 shown in FIG. 3.

FIGS. 6B and 6C are a plan view and an underneath view, respectively, of the housing 73, 101. The top side comprises recesses 103, 105 for receiving the plugs (not shown). Via aperture 107, 109 the operating members 85, 87 of the switches 19, 21 extend into said recesses so as to be able to cooperate with the plugs in the manner described with reference to FIG. 3. The bulges 81 and 83 in the first switching contacts 69 and 71 in the closed position of the switches 19 and 21 engage the first part 91 of the central connection element 15. The places where the bulges 81, 83 engage the first part 91 constitute the second (rigid) switching contacts of the switches 19, 21. The bulge 79 in the third projecting part 77 of the connection plate 65 resiliently engages the first part 89 of the connection element 13 so that the said connection element is connected via the connection plate to the second terminal 27 of the resistance element 25.

The housing 73, 101 as well as the housing 43 comprises two laterally projecting parts 111 with continuous holes 113 through which connection bolts (not shown) can be inserted. Said projecting parts are present in the second envelope 101.

I claim:

1. A connector comprising an electrically insulating housing comprising at least two connection elements formed from an electrically conductive material each of which comprises two first contact members and a connection member as well as two electrically parallel arranged normally closed switches each of which in the closed condition constitutes an electric connection between on the one hand one of the connection elements and on the other hand a first terminal of a resistance element the second terminal of which is electrically conductively connected to another of the connection elements, each one of said switches comprising an operating member which cooperates with a plug having second contact members which are capable of cooperating with the first contact members, all this in such a manner that when the plug is inserted into the housing one of the two switches is opened, characterized in that at least the part of each connection element which comprises the first contact members is formed from one piece of sheet material, that an electrically conductive switching plate likewise formed from one piece of sheet material is connected to the first terminal of the resistance element and comprises a first switching contact of each of the two switches and that the second switching contact of each of the two switches forms a unitary structure with said part of one of the connection elements.

2. A connector as claimed in claim 1, characterized in that the connection members together with the first contact members are formed as a unitary structure from one piece of sheet material.

3. A connector as claimed in claim 2, characterized in that the resistance element, the connection elements and the switching plate are placed in apertures recessed in the preformed housing, the switching plate engaging the first terminal of the resistance element and one of the connection elements engaging the second terminal, and that the second switching contacts are movable and comprise the operating members.

4. A connector as claimed in claim 2, characterized in that the switching plate comprises a first projecting part and together with a connection plate comprising a second projecting part is embedded in a synthetic resin envelope which forms a part of the housing, that the first terminal of the resistance element is connected to the first projecting part and the second terminal to the second projecting part, that the first switching contacts are movable and comprise the operating members, and that the connection plate is further connected to one of the connection elements.

5. A connector as claimed in claim 1, characterized in that the resistance element, the connection elements and the switching plate are placed in apertures recessed in the preformed housing, the switching plate engaging the first terminal of the resistance element and one of the connection elements engaging the second terminal, and that the second switching contacts are movable and comprise the operating members.

6. A connector as claimed in claim 1, characterized in that the switching plate comprises a first projecting part and together with a connection plate comprising a second projecting part is embedded in a synthetic resin envelope which forms a part of the housing, that the first terminal of the resistance element is connected to the first projecting part and the second terminal to the second projecting part, that the first switching contacts are movable and comprise the operating members, and that the connection plate is further connected to one of the connection elements.

* * * * *